US006532759B1

(12) United States Patent
van den Berg et al.

(10) Patent No.: US 6,532,759 B1
(45) Date of Patent: Mar. 18, 2003

(54) ELECTRO-MECHANICAL HEAT SWITCH FOR CRYOGENIC APPLICATIONS

(75) Inventors: Marcel L. van den Berg, Oakland, CA (US); Jan D. Batteux, Hayward, CA (US); Simon E. Labov, Berkeley, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/934,976

(22) Filed: Aug. 21, 2001

(51) Int. Cl.[7] ..... F25D 3/12

(52) U.S. Cl. ..... 62/383; 62/50.7; 165/96 HV; 165/DIG. 132

(58) Field of Search ..... 62/50.7, 3.1, 383; 165/96 HV, DIG. 132, DIG. 133, DIG. 134

(56) References Cited

U.S. PATENT DOCUMENTS

| | | | | |
|---|---|---|---|---|
| 2,913,881 A | * | 11/1959 | Garwin | 165/96 |
| 3,841,107 A | * | 10/1974 | Clark | 165/96 |
| 3,904,167 A | * | 9/1975 | Touch et al. | 137/606 |
| 4,175,736 A | | 11/1979 | Dietlien | 269/88 |
| 4,281,708 A | * | 8/1981 | Wing et al. | 165/277 |
| 4,292,612 A | * | 9/1981 | Howell | 335/14 |
| 4,771,823 A | | 9/1988 | Chan | 165/61 |
| 5,671,705 A | * | 9/1997 | Matsumoto et al. | 123/90.11 |
| 5,742,467 A | * | 4/1998 | Schmitz | 361/154 |
| 5,765,514 A | * | 6/1998 | Sono et al. | 123/90.11 |
| 5,934,077 A | | 8/1999 | Martinis | 62/3.1 |

OTHER PUBLICATIONS

C. Hagmann and P.L. Richards, Adiabatic demagnetization refrigerators for small laboratory experiments and space astronomy,: Cryogenics, vol. 35, No. 5, 1995, pp. 303–309.*

C. Hagmann and P.L. Richards, "Adiabatic demagnetization refrigerators for small laboratory experiments and space astronomy," *Cryogenics,* vol. 35, No. 5, 1995, pp. 303–309.

* cited by examiner

*Primary Examiner*—William C. Doerrler
(74) *Attorney, Agent, or Firm*—James S. Tak; Alan H. Thompson

(57) ABSTRACT

A heat switch includes two symmetric jaws. Each jaw is comprised of a link connected at a translatable joint to a flexible arm. Each arm rotates about a fixed pivot, and has an articulated end including a thermal contact pad connected to a heat sink. The links are joined together at a translatable main joint.

To close the heat switch, a closing solenoid is actuated and forces the main joint to an over-center position. This movement rotates the arms about their pivots, respectively, forces each of them into a stressed configuration, and forces the thermal contact pads towards each other and into compressive contact with a cold finger.

The closing solenoid is then deactivated. The heat switch remains closed due to a restoring force generated by the stressed configuration of each arm, until actuation of an opening solenoid returns the main joint to its starting open-switch position.

23 Claims, 5 Drawing Sheets

ELECTRO-MECHANICAL HEAT SWITCH FOR CRYOGENIC APPLICATIONS

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to a heat switch and, more particularly, to a heat switch used in conjunction with a cryogenic refrigerator.

2. Description of Related Art

A heat switch is used to conduct heat when closed, and to prevent heat conduction when open. It is used in a variety of cryogenic application where temperature must be controlled and, in particular, comprises an essential component of an adiabatic demagnetization refrigerator ("ADR"). ADRs are discussed in C. Hagmann and P. L. Richards, "Adiabatic demagnetization refrigerators for small laboratory experiments and space astronomy," *Cryogenics*, vol. 35, no. 5, 1995, pp. 303–309. As noted therein, ADRs are capable of reaching operating temperatures below 0.01 K, but typically operate at temperatures near 0.1 K. Such refrigerators are commonly used for small laboratory experiments, space astronomy, and detectors for millimeter waves, X-rays and dark matter. ADRs can also operate in zero gravity, which would make them useful in satellites and space vehicles.

An ADR typically includes a paramagnetic material suspended in the refrigerator, e. g., a paramagnetic salt such as ferric ammonium alum or chronic cesium alum. The paramagnetic material is in thermal contact with an elongated metal rod called a "cold finger," which is, in turn, in thermal contact with a cold stage. The cryogenic experiment or instrument that makes use of the cold provided by the ADR is attached to the cold stage. When closed, the heat switch provides for thermal conduction between the paramagnetic material and a heat sink having a temperature of 1° to 4° Kelvin.

The ADR cycle begins by closing the heat switch to thermally connect the paramagnetic material to the heat sink. A strong magnetic field is then applied to the paramagnetic material to align the magnetic moments of the material. This reduces the entropy of the moments, and the heat of magnetization thereby released is transferred by conduction through the closed heat switch to the heat sink. This process is isothermal.

The switch is then opened to thermally isolate the paramagnetic material from the heat sink as well as extraneous sources of thermal energy, and the applied magnetic field is decreased. The temperature of the material decreases as magnetic moments in the material lose their alignment and entropy is transferred from the lattice to the magnetic moments. The result is an adiabatic drop in the temperature of the paramagnetic material and thus the cold stage. When the material is partially demagnetized to a desired operating temperature, the temperature can be held constant by very slowly reducing the magnetic field to compensate for heat leakage. By regulation of the magnetic field, a stable temperature can be maintained in the cold stage for many hours, after which the cycle is begun again.

The requirements for heat switches to be used in conjunction with ADRs include a high ratio of dosed to open thermal conductivity, reliability, and low heat emission from the operation of the switch itself. Mechanical, electromechanical, and gas-gap heat switches have all been used. Gas-gap heat switches use the thermal conductivity of helium contained between two surfaces. Activated charcoal absorbs the He gas when the switch is open. Because they are always closed at a temperature less than 30° Kelvin, the initial cool-down of the ADR is facilitated. However, this type of switch has the disadvantage of having a finite conductance in the open state due to conduction through the gas tight container. Furthermore, the charcoal must be warmed to absorb the He gas, and this comprises the dominant heat leak for small ADRs. As a result of the two foregoing drawbacks, the mass of paramagnetic salt must be increased in order to obtain a useful cold period, causing concomitant increases in the weight and size of the ADR. C. Hagmann and P. L. Richards, supra, at 306.

In view of the aforementioned problems endemic to gas-gap heat switches, it has been found that mechanical and electromechanical heat switches offer the best performance. An electromechanical heat switch is described and illustrated in C. Hagmann and P. L. Richards, supra, at 305. The heat switch shown therein uses a solenoid to force the translation of a plunger that, in turn, forces jaws into normal contact with a cold finger. The drawback attendant to this apparatus is that to keep the jaws closed and in continuous contact with the cold finger, the solenoid must remain actuated for the duration of the isothermal heat transfer to the heat sink, as well as during the lengthy period required to initially cool the ADR down from room temperature. The continuous current generates heat from ohmic resistance that will be conducted into the heat sink and the ADR, thus adversely affecting the ADR's performance. Furthermore, this continuous actuation reduces the force the solenoid can generate and apply below that available during a short actuation pulse.

There is a need in the art for an electromechanical heat switch that remains closed with sufficient normal force on the cold finger to provide thermal conduction to the heat sink, but without generating the increased thermal energy attendant to keeping the solenoid operative throughout this step of the refrigeration cycle. The present invention not only fulfills this need in the art, but also applies a normal force against the cold finger greater than that of the heat switches of the prior art, and thus improves on the thermal conduction provided by the prior art switches.

SUMMARY OF THE INVENTION

Briefly, the present invention is a heat switch this is of particular advantage when used in conjunction with an ADR. The heat switch includes two symmetric jaws. Each jaw is comprised of a link connected at a joint to a flexible arm. The joints are translatable. Each arm rotates about a fixed pivot, and has an articulated end including a thermal contact pad that is thermally connected to a cryogenic heat sink by a metal braid. The links are joined together at a main joint that can move along a path that is collinear with the longitudinal axis of the plunger for a closing solenoid.

To close the switch, the closing solenoid is actuated and its plunger forces the main joint to an over-center position, beyond an unstable center position where the two links are aligned with their respective arms at the joints. This movement rotates the arms, bends them into a stressed configuration, and forces the thermal contact pads towards each other and into compressive contact with a cold finger that lies between them. This contact provides for the exhaust to the heat sink of the heat of magnetization released during the application of a magnetic field to the paramagnetic material inside the ADR. It also provides thermal contact for cooling the paramagnetic material and cold stage when the heat switch is closed during the initial cooling from room temperature.

Once the over-center position of the main joint is achieved, the closing solenoid is deactivated. The heat switch remains closed by virtue of the restoring force applied by the stressed arms. When the isothermal heat exhaust step is completed, actuation of an opening solenoid opens the heat switch by pushing the main joint up and beyond the center position, and the heat switch is returned to its starting open-switch position. With the switch open, the cold stage is thermally isolated from everything except the paramagnetic material. The cold stage is cooled by gradually decreasing the applied magnetic field.

DETAILED DESCRIPTION OF THE INVENTION

Figure 2:
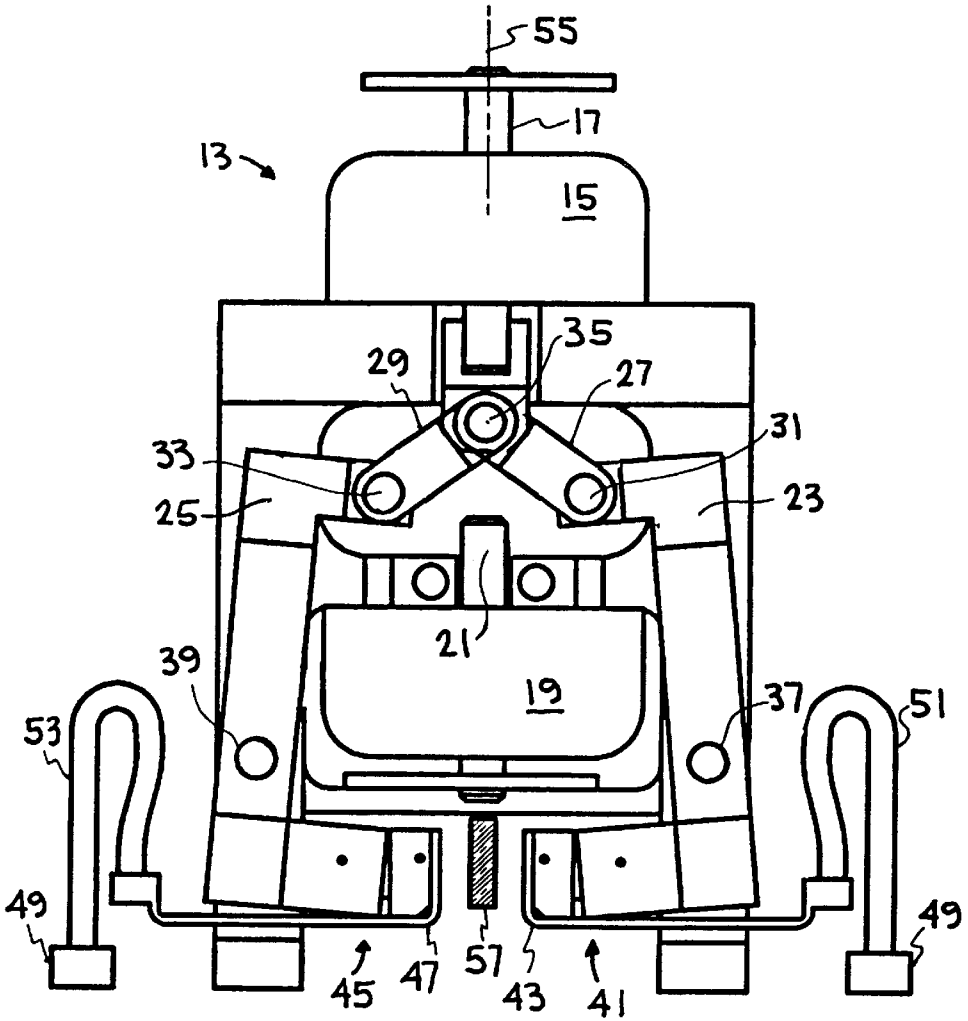
FIG. 2 is a front view of the heat switch in the open position.
Figure 1:
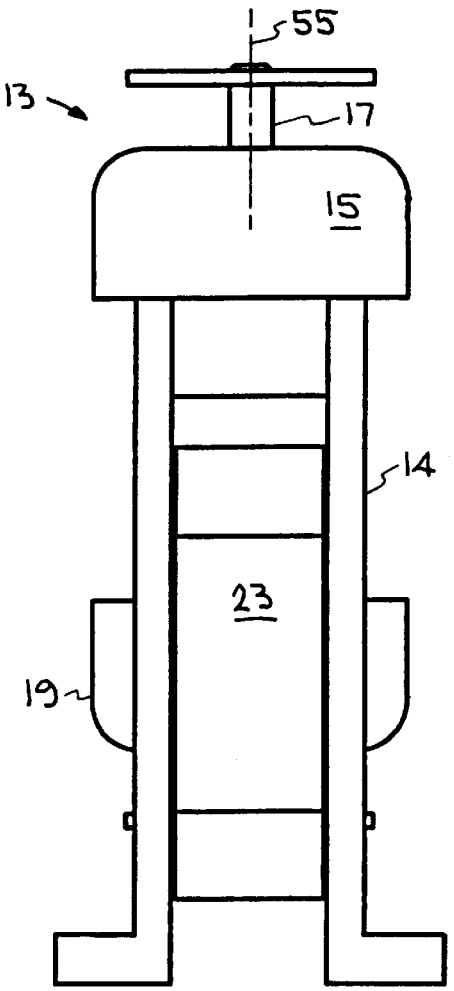
FIG. 1 is a side view of a heat switch of the present invention.
Figure 3:
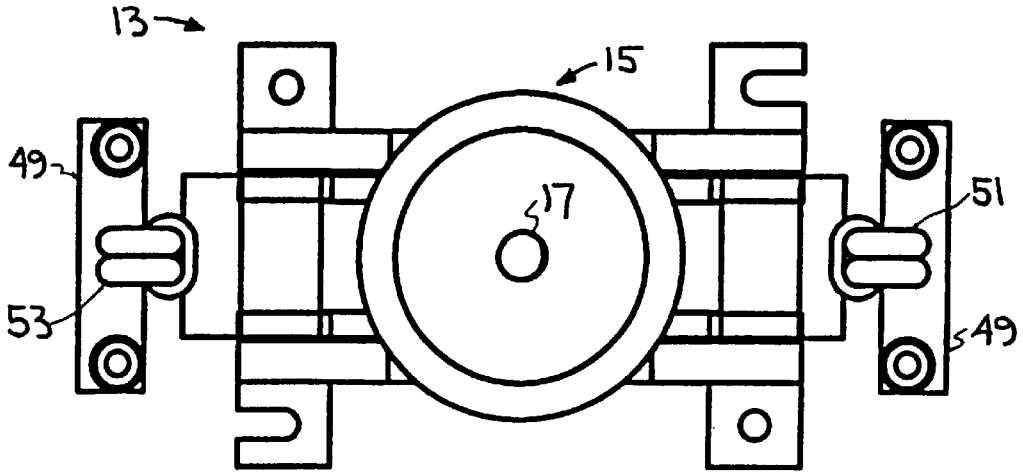
FIG. 3 is a top view of the heat switch.
Figure 4:
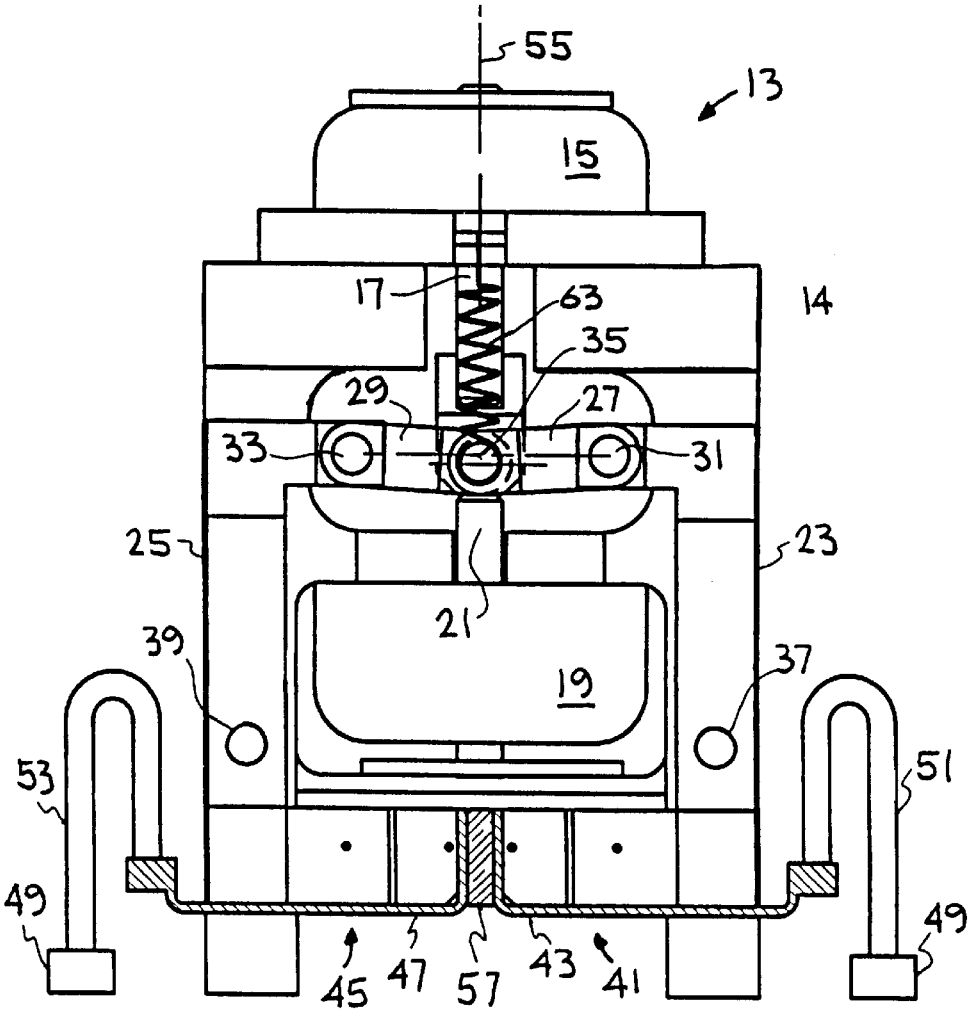
FIG. 4 is a front view the heat switch, wherein the switch is in the closed position.

Turning to the drawings, FIGS. 1, 2 and 3 show side, front and top views, respectively, of heat switch 13 of the present invention. Heat switch 13 is shown in the open, non-conducting position. FIG. 4 is a front view of switch 13 wherein the switch is shown in the closed, thermally conducting position.

Heat switch 13 includes casing 14, closing solenoid 15 having plunger 17, opening solenoid 19 having plunger 21, arms 23 and 25, and links 27 and 29. Arm 23 and link 27 are rotatably attached by joint 31. Arm 25 and link 29 are rotatably attached by joint 33. Links 27 and 29 are rotatably attached to each other at main joint 35. Arm 23 rotates about pivot 37, and arm 25 rotates about pivot 39.

Arm 23 includes articulated end 41 having thermal contact pad 43 attached thereto. Arm 25 includes articulated end 45 having thermal contact pad 47 attached thereto. Thermal contact pad 43 thermally communicates with heat sink 49 via metallic braid 51. Thermal contact pad 47 thermally communicates with heat sink 49 via metallic braid 53. Heat sink 49 is maintained at a temperature of 10° to 40° Kelvin.

Plungers 17 and 21 share axial centerline 55. When actuated, plungers 17 and 21 move in opposite direction along centerline 55. Centerline 55 intersects the center of main joint 35. Main joint 35 translates linearly along centerline 55. Pivots 37 and 39 are attached to casing 14, and thus remain stationary relative to casing 14. Joint 31 translates along a fixed radius of curvature having a center at pivot 37. Joint 33 translates along a fixed radius of curvature having a center at pivot 39.

An ADR (not shown) includes cold finger 57 and a salt pill (not shown). A cold stage (not shown) is attached to and thermally communicates with cold finger 57. The salt pill is composed of a paramagnetic salt, and also thermally communicates with the cold finger, and therefore the cold stage. FIG. 2 shows heat switch 13 in the open, non-conductive position. Thermal contact pads 43 and 47 are spaced apart from cold finger 57 when heat switch 13 is in the open position, and the cold stage and salt pill thus are isolated from heat sink 49.

To close heat switch 13, closing solenoid 15 is actuated to force plunger 17 downward along centerline 55. This pushes main joint 35 over its center position, i. e., the position where links 27 and 29 are aligned and horizontal. More particularly, the force generated by closing solenoid 15 and the stroke of plunger 17 are sufficient to force main joint 35 to an over-center position in contact with plunger 21. Closing solenoid 15 is deactivated when this position is reached.

Figure 5:
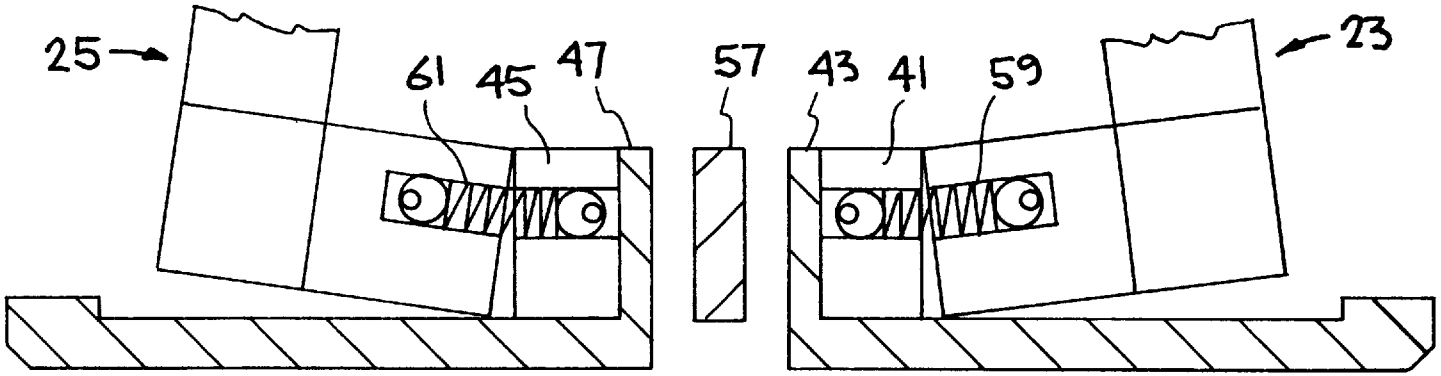
FIG. 5 is a front view of the articulated arm ends and attached thermal contact pads of the heat switch with the heat switch in the open position.
Figure 6:
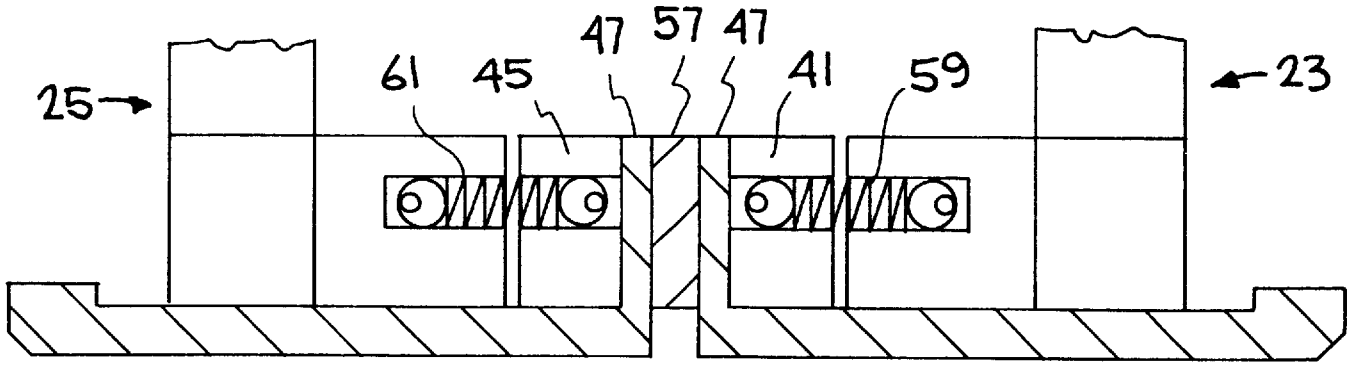
FIG. 6 is a front view of the arm ends and attached thermal contact pads shown in FIG. 5, with the heat switch in the closed position.

The closed position of heat switch 13 is shown in FIG. 4. As may be discerned by comparing FIGS. 3 and 4, the downward motion of plunger 17 and main joint 35 causes the rotation of arms 23 and 25 about pivots 37 and 39, respectively, until thermal contact pads 43 and 47 abut cold finger 57. As shown in FIGS. 5 and 6, the articulation of ends 41 and 45 is facilitated by compressed springs 59 and 61, respectively.

Arms 23 and 25 are flexible, so that they bend when heat switch 13 is closed and act as a pair of compressed springs. Arms 23 and 25 continue to apply a compressive force against links 27 and 29 to keep the switch in the closed, over-center position, as well as against both sides of cold finger 57. Thus the switch remains in the closed position even after closing solenoid 15 has been deactivated.

To open heat switch 13, opening solenoid 19 is actuated to push plunger 21 upward along centerline 55. The force generated by solenoid 19 is sufficient to overcome the compressive load applied by arms 23 and 25, and push main joint 35 out of its over-center position. Opening is completed by spring 63 (shown only in FIG. 4), which is attached at its ends to casing 14 and main joint 35, respectively, and is in tension that is increased when heat switch 13 is closed.

The refrigeration cycle of the ADR is begun by closing heat switch 13 and applying a magnetic field to the salt pill. As the magnetic moments of the salt become aligned, the heat of magnetization is generated and transferred by conduction through cold finger 57, thermal contact pads 43 and 45, and braids 51 and 53, to heat sink 49. The foregoing process is isothermal.

After a pause to achieve thermal equilibrium, heat switch 13 is opened and the magnetic field is adiabatically decreased. The temperature of the salt falls as entropy is transferred from the salt lattice to the magnetic moments.

The salt pill is partially demagnetized to a desired operating temperature, after which the magnetic field is isothermally reduced to compensate for incidental heat conduction to the salt pill. The cryogenic experiment or instrument using the cold temperature obtained by demagnetizing the salt pill is mounted to the cold stage, which is in thermal communication with the salt pill via cold finger 49. By regulating the magnetic field, a stable temperature can be maintained for hours, after which the ADR must be cycled again.

Figure 8:
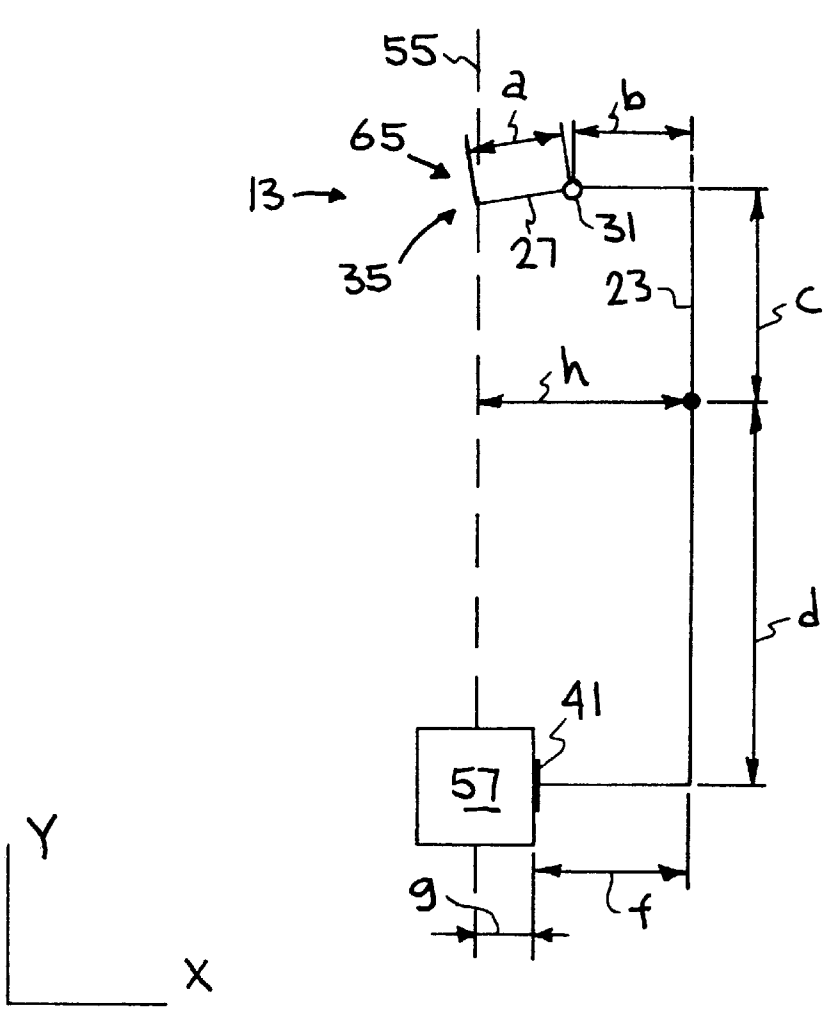
FIG. 8 is a schematic drawing of one of the jaws of the heat switch in the closed position.
Figure 7:
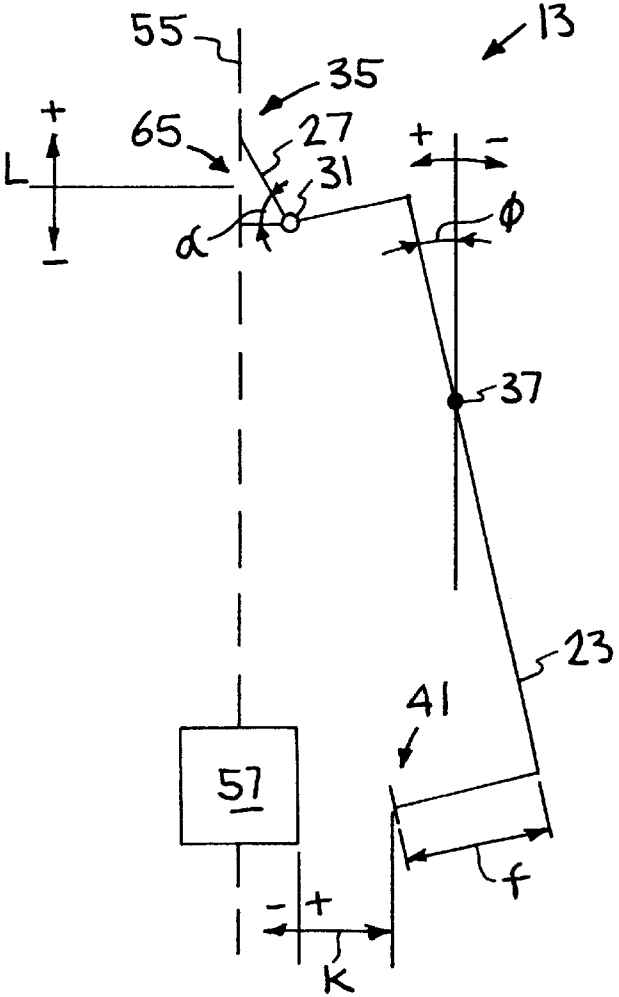
FIG. 7 is a schematic drawing of one of the jaws of the heat switch in the open position.

FIGS. 7 and 8 are schematic drawings of the right half of heat switch 13 in the open and closed positions, respectively, and are provided to facilitate a better understanding of the present invention in conjunction with the following discussion. The angle $\phi$ denotes the angle of rotation of arm 25, where $\phi=0°$ when arm 25 is vertical. Of particular significance is the relationship between:

K, the distance between cold finger 57 and thermal contact pad 45; and

L, the distance between the center of main joint 35 and origin 65 on centerline 55, with L>0 being above origin 65 and L<0 being below origin 65; where origin 65 is the location of main joint 35 when $\alpha=0°$; and $\alpha$ is the angle between link 27 and the horizontal.

The variables a, b, c, d, f, g and h are defined in FIG. 8 as they pertain to the illustrated elements comprising heat switch 13.

Both K and L are related to the angle $\phi$ by the rotational matrix R:

$$R=\begin{pmatrix}\cos\phi & -\sin\phi\\ \sin\phi & \cos\phi\end{pmatrix} \tag{1}$$

It follows that $$K(d,g,h,\phi)=d\sin\phi-f\cos\phi-g+h \tag{2}$$

and $$\begin{aligned}L(a,b,c,f,g,\phi)&=-b\sin\phi+c(\cos\phi-1)+a\sin\alpha\\&=-b\sin\phi+c(\cos\phi-1)\pm\\&\quad\sqrt{a^2-(h-b\cos\phi-c\sin\phi)^2}\end{aligned} \tag{3}$$

Note that L is symmetric only around the origin if a+b=f+g=h, which is clearly not the case of interest. Further, $\phi=0°$ does not necessarily correspond to heat switch 13 being closed.

The derivatives of K and L with respect to $\phi$ are:

$$\frac{dK}{d\phi}=d\cos\phi+f\sin\phi \tag{4}$$

$$\frac{dK}{d\phi}=-b\cos\phi-c\sin\phi\pm\frac{(-b\sin\phi+c\cos\phi)(h-b\cos\phi-c\sin\phi}{\sqrt{a^2-(h-b\cos\phi-c\sin\phi)^2}} \tag{5}$$

From the structure shown in FIGS. 7 and 8, a minimum and maximum for the angle $\phi$ may easily be deduced:

$$\phi_{\min}=\arcsin\left(\frac{h-a}{\sqrt{b^2+c^2}}\right)-\arctan\left(\frac{b}{c}\right) \tag{6}$$

-continued $$\phi_{\max}=\arcsin\left(\frac{h}{a+\sqrt{b^2+c^2}}\right)-\arctan\left(\frac{b}{c}\right) \tag{7}$$

The maximum for the angle $\phi$, $\phi_{max}$, is calculated assuming that heat switch 13 is opened by moving main joint 35 upwards. For main joint 35 moving downwards the maximum angle, $\phi_{max}$, is larger:

$$\phi_{\max}\cong\arcsin\left(\frac{h-0.1''}{\sqrt{b^2+c^2}}\right)-\arctan\left(\frac{b}{c}\right) \tag{8}$$

Figure 9:
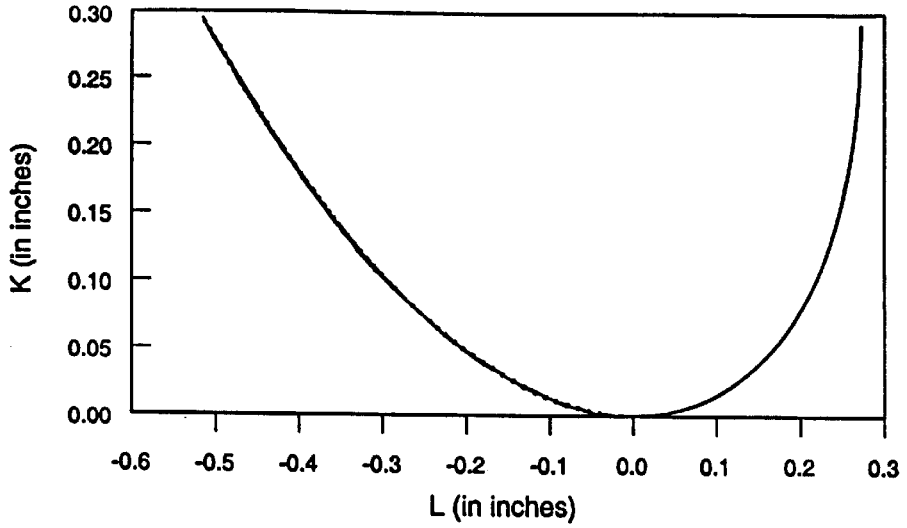
FIG. 9 is a graph showing an example of the translation of the end of one of the arms versus the displacement of the plunger on the closing solenoid.

FIG. 9 is a graph showing the opening K as a function of the translation of main joint 35, L, for the following example comprised of a set typical parameters (in inches).

a=0.5 b=0.5 c=1.0 d=1.365 f=0.85 g=0.15 h=1.0

Obviously, the curve is quite asymmetric. For a large opening, K, of heat switch 13, it is optimal to have the open state at L>0, whereas for a large closing force it would be advisable to have L<0 when in the open state.

The force, $F_K(x)$, that can be exerted parallel to the x axis by thermal contact pad 47 on cold finger 57 is given by the following equation:

$$F_K(x)=F_L(y))\frac{dL}{d\phi}\Big/\frac{dK}{d\phi} \tag{9}$$

where:

$F_L(y)$ is the force parallel to the y axis applied by plunger 17 to main joint 35.

Figure 10:
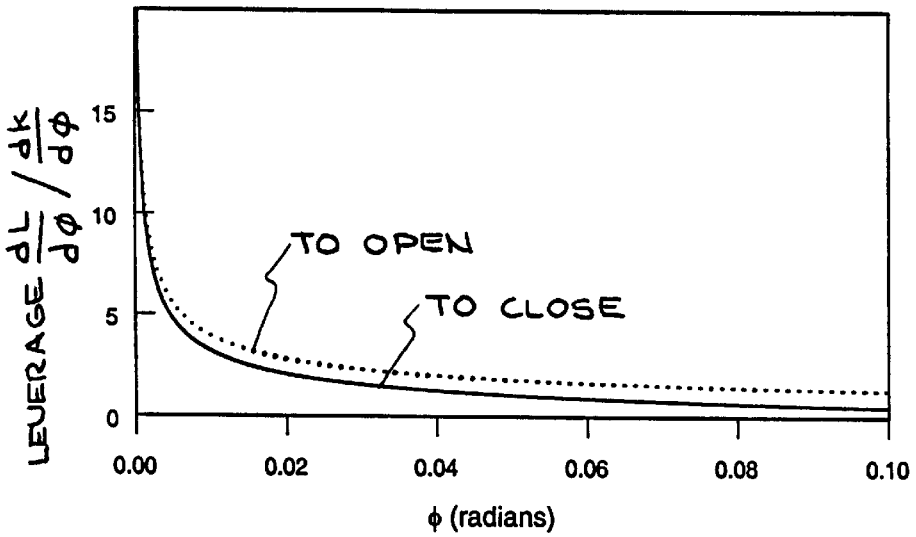
FIG. 10 is a graph showing an example of leverage versus the rotation angle of one of the arms about its fixed pivot, for both opening and closing the heat switch.

FIG. 10 shows the force translation curve $$\left|\frac{dL}{d\phi}\Big/\frac{dK}{d\phi}\right|$$

as a function of $\phi$ for the aforementioned typical set of parameters, for both opening and closing heat switch 13. Clearly the leverage becomes infinite for $\phi=\phi_{min}$.

The force $F_L(y)$ is given by the specifications for closing solenoid 15 and opening solenoid 19. To close heat switch 13 having the aforementioned typical set of parameters, a Ledex low profile linear solenoid type 4EC having a maximum stroke of about 12 mm, or 0.47" was used for closing solenoid 15. To open heat switch 13, a Ledex 4EF solenoid, having a shorter stroke but larger force than the type 4EC, was used for the opening solenoid 19.

In order to make optimum use of the opening force provided by opening solenoid 19, spring 63 is used to completely open heat switch 13. With spring 63 applying a 2 lbs. tensile force to main joint 35 at $\phi=\phi_{min}$, and a 1 lb. tensile force when heat switch 13 is completely open, the force $F_L(y)$ is given by:

$$F_{L,}\text{open}(y)=F_{19}(L(\phi_{min})-L(\phi))+F_{63} \tag{10}$$

$$F_{L,}\text{close}\ (y)=F_{15}(L(\phi_{min})+L_0))-F_{63} \tag{11}$$

where:

$L_0$ is the distance main joint 35 travels between origin 65, i. e.,. L ($\phi_{min}$), and the closed position, and $$F_{63} = 2 - \frac{L - L(\phi_{\min})}{S - L_0} \quad (12)$$

and

Figure 11:
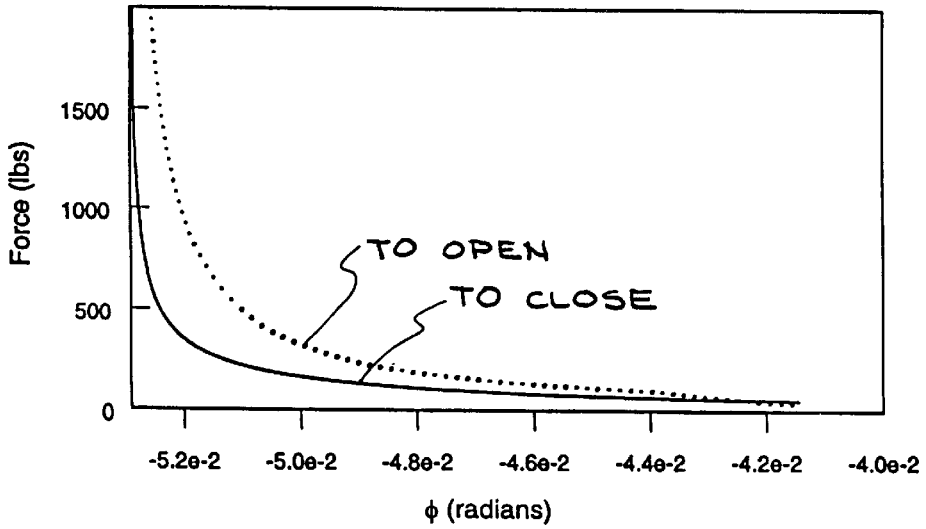
FIG. 11 is a graph showing an example of force versus the rotation angle of one of the arms about its fixed pivot, for both opening and closing the heat switch.

S is the maximum stroke of plunger 21 of opening solenoid 19. FIG. 11 is a graph showing the force applied to thermal contact pad 47 by closing solenoid 15 and opening solenoid 19 as a function of $\phi$ with L>0 for the open state using the aforementioned typical parameters and spring 63.

Arm 25 has a finite elasticity, given by a spring constant $k_d$ or a sliding modulus $G_d=k_d \times d$. Thus, when heat switch 13 is closed, arm 25 slightly bends. This provides for an added normal force against cold finger 57, i. e., K<0 in the closed position. The bending of arm 25 also applies a downward force against main joint 35 to keep it locked in the closed, over-center position until opened by opening solenoid 19.

The maximum force that spring 63 can exert on main joint 35 in the closed switch position is:

$$\mathrm{Min}(F_{L,}\mathrm{close}(L(\phi_{min})-L_0),\ F_{L,}\mathrm{open}(L(\phi_{min})-L_0))-2 \quad (13)$$

where 2 lbs. have been subtracted to allow for possible friction.

It is to be understood that the foregoing description relates to an embodiment of the invention, and that modifications may be made thereto without departing from the spirit and scope of the invention as set forth in the following claims.

What is claimed is:

1. A switch for changing from providing thermal conduction to being nonconductive, comprising:

a closing solenoid for forcing a first arm into a closed position to provide for thermal conduction between a first element and a second element;

the closing solenoid being actuated to force the first arm into the closed position, and thereafter being deactivated;

the first arm being flexible to maintain the closed position; and an opening solenoid for forcing the first arm into an open position wherein the switch is thermally nonconductive with respect to the first and second elements.

2. The switch as defined in claim 1 wherein:

the first arm can be deformed from a non-stressed configuration in the open position, to a stressed configuration in the closed position; and the first arm generating a restoring force in the stressed position tending to hold the first arm in the closed position.

3. The switch as defined in claim 2 wherein:

the first arm has a first end linearly translating along a centerline responsive to the closing solenoid;

the restoring force being responsive to the linear translation of the first end;

the restoring force having a maximum value when the restoring force is normal to the centerline; and the restoring force having a locking value when the first arm is in the closed position, with the locking value being less than the maximum value.

4. The switch as defined in claim 3 further comprising:

a switch casing; and the first arm being rotatable about a pivot having a location that is fixed relative to the switch casing.

5. The switch as defined in claim 4 wherein:

the first arm includes a link rotatably attached by a joint;

the link defining the first end; and the joint translating along a radius of curvature having the pivot as its center.

6. The switch as defined in claim 3 further comprising:

a spring attached to the first arm; and the spring applying a spring force tending to force the first arm into the open position.

7. The switch as defined in claim 3 wherein:

the first arm is in thermal communication with the first element; and the first arm thermally communicates with the second element when the first arm is in the closed position.

8. The switch as defined in claim 7 wherein:

the first arm has an articulated end for abutting the second element; and the articulated end includes a spring in compression.

9. The switch as defined in claim 8 wherein:

the second element is a cold finger; and the first element is a heat sink.

10. The switch as defined in claim 9 wherein:

the cold finger thermally communicates with a paramagnetic material that is part of an adiabatic demagnetization refrigerator;

the closing solenoid and the opening solenoid are actuated responsive to a refrigeration cycle of the adiabatic demagnetitzation refrigerator; and the heat sink is at a temperature of 1° to 4° Kelvin.

11. The switch as defined in claim 3 further comprising:

a second arm identical to the first arm;

the second arm being rotatably connected to the first arm at a main joint; and the main joint translating along the centerline responsive to the closing solenoid and the opening solenoid.

12. The switch as defined in claim 11 wherein the first arm and the second arm are symmetrically disposed about the centerline.

13. A switch for alternatively providing thermal communication and being nonconductive, comprising:

a pair of rotatable jaws;

a closing solenoid for rotating the jaws into a closed position providing for thermal conduction between a first element and a second element, and for deforming the jaws into a stressed configuration when the jaws are in the closed position;

the jaws generating a restoring force when in the stressed configuration, that tends to hold the jaws in the closed position; and an opening solenoid for overcoming the restoring force and rotating the jaws into an open position.

14. The switch as defined in claim 13 wherein:

the jaws are rotatably attached to each other at a main joint;

the closing solenoid rotates the jaws by forcing the main joint to linearly translate in a closing direction.

15. The switch as defined in claim 14 wherein:

the opening solenoid rotates the jaws by forcing the main joint to linearly translate in an opening direction;

the main joint linearly translates along a centerline; and the opening direction is opposite from the closing direction.

16. The switch as defined in claim 15 wherein the restoring force intersects the centerline.

17. The switch as defined in claim 15 wherein the jaws are symmetrically disposed about the centerline.

18. The switch as defined in claim 16 further comprising an opening spring attached to the main joint applying a spring force in the opening direction.

19. The switch as defined in claim 16 further comprising:

a switch casing; wherein each of the jaws includes an arm and a link;

the arm is rotatably attached to the link at a joint;

the arm rotates about a pivot; and the joint is translatable and the pivot is stationary relative to the switch casing.

20. The switch as defined in claim 19 wherein the joint translates along a radius of curvature having a center located at the pivot.

21. The switch as defined in claim 19 wherein:

each of the arms includes a thermal contact pad;

the thermal contact pad thermally communicates with the first element; and the thermal contact pad abuts the second element when the jaw is in the closed position, whereby thermal conduction between the first element and the second element is obtained.

22. The switch as defined in claim 21 wherein:

each of the arms includes an articulated end having a compressed spring; and the thermal contact pad is attached to the articulated end.

23. The switch as defined in claim 22 wherein:

the first element is a heat sink having a temperature of 1° to 4° K; and the second element is a cold finger that thermally communicates with a paramagnetic material located in an adiabatic demagnetization refrigerator.

* * * * *